US008245432B2

(12) United States Patent
Letson

(10) Patent No.: US 8,245,432 B2
(45) Date of Patent: Aug. 21, 2012

(54) ADJUSTABLE RECOIL REDUCING SHOOTING REST

(76) Inventor: Jerry Letson, Madison, MS (US)

( * ) Notice: Subject to any disclaimer, the term of this patent is extended or adjusted under 35 U.S.C. 154(b) by 238 days.

(21) Appl. No.: 12/603,900

(22) Filed: Oct. 22, 2009

(65) Prior Publication Data

US 2011/0094140 A1 Apr. 28, 2011

(51) Int. Cl.
*F41C 27/00* (2006.01)

(52) U.S. Cl. ..... 42/94; 42/97; 89/37.04

(58) Field of Classification Search ..... 42/94, 97; 89/37.04; 73/167, 11.04
See application file for complete search history.

(56) References Cited

U.S. PATENT DOCUMENTS

| | | | | | |
|---|---|---|---|---|---|
| 1,367,353 | A | | 2/1921 | Craig | |
| 1,457,407 | A | | 6/1923 | Stokes | |
| 2,378,545 | A | | 6/1945 | Fraser | |
| 2,582,140 | A | * | 1/1952 | Leek | 89/44.01 |
| 2,599,265 | A | | 6/1952 | Leek | |
| 2,817,233 | A | | 12/1957 | Dower | |
| 3,225,656 | A | | 12/1965 | Flaherty | |
| 3,805,608 | A | | 4/1974 | Schmidt | |
| 4,012,860 | A | | 3/1977 | Auger | |
| 4,026,057 | A | * | 5/1977 | Cady | 42/94 |
| 4,333,385 | A | | 6/1982 | Culver | |
| 4,799,324 | A | | 1/1989 | Nodo | |
| 4,841,839 | A | * | 6/1989 | Stuart | 89/37.04 |
| 4,876,814 | A | * | 10/1989 | Lombardo | 42/94 |
| 4,972,619 | A | * | 11/1990 | Eckert | 42/94 |
| 4,987,694 | A | * | 1/1991 | Lombardo | 42/94 |
| 5,056,410 | A | | 10/1991 | Pitts | |
| 5,070,636 | A | | 12/1991 | Mueller | |
| 5,081,783 | A | | 1/1992 | Jarvis | |
| 5,272,955 | A | * | 12/1993 | Bond et al. | 89/37.04 |
| 5,628,135 | A | | 5/1997 | Cady | |
| 5,811,720 | A | | 9/1998 | Quinnell | |
| 5,913,668 | A | * | 6/1999 | Messer | 42/94 |
| 6,293,041 | B2 | | 9/2001 | Weaver | |
| 6,973,749 | B2 | | 12/2005 | Levilly | |
| 7,313,884 | B2 | | 1/2008 | Eddins | |
| 7,356,960 | B1 | | 4/2008 | Knitt | |
| 7,774,972 | B2 | * | 8/2010 | Potterfield et al. | 42/94 |
| 7,823,317 | B2 | * | 11/2010 | Potterfield et al. | 42/94 |
| 7,823,318 | B2 | * | 11/2010 | Hall | 42/94 |
| 7,946,071 | B2 | * | 5/2011 | Cauley | 42/94 |
| 7,997,021 | B2 | * | 8/2011 | Cauley et al. | 42/94 |
| 8,006,426 | B1 | * | 8/2011 | Carroll | 42/94 |
| 8,011,129 | B2 | * | 9/2011 | Cauley et al. | 42/94 |
| 2005/0000141 | A1 | | 1/2005 | Cauley | |
| 2009/0025267 | A1 | | 1/2009 | Reinert | |

* cited by examiner

*Primary Examiner* — Michael David
(74) *Attorney, Agent, or Firm* — Ashley Law Firm P.C.; Stephen S. Ashley, Jr.

(57) ABSTRACT

An adjustable recoil reducing shooting rest disclosed. The shooting rest may be adjusted to absorb differing amounts of recoil from various rifles to prevent rifle bounce that may add to aim inaccuracy. The user may also adjust both the horizontal and vertical aim of the rifle to consistently aim at the same location after multiple shots. The shooting rest may be secured to an unmodified support surface, and the rest consistently supports the butt stock of the rifle regardless of the vertical angle of the rest.

20 Claims, 6 Drawing Sheets

ADJUSTABLE RECOIL REDUCING SHOOTING REST

FIELD OF THE INVENTION

This invention relates generally to firearm accessories and specifically to a firearm rest that adjustably absorbs the recoil of the firearm when it is fired while maintaining consistent support on the butt stock of the rifle regardless of the position of the rifle.

BACKGROUND OF THE INVENTION

Sportsmen often wish to test fire new rifles to ensure that the rifle in question fires accurately. The recoil that is created when a rifle is fired can often cause human error and prevent accurate shooting. This additional source of error can make it difficult for the user to determine whether any misses are due to an inaccurate rifle or an inaccurate marksman. Furthermore, some sportsmen wish to set a rifle up in a hidden location to fire on wild game. These sportsmen also want to accurately fire a rifle at a predetermined location and would like to use a device to do so accurately in a repeatable manner. Also, sportsmen with disabilities that impair normal rifle use may wish to use a device to hold a rifle for them.

Several shooting rests have been created to accommodate these sportsmen. These shooting rests hold a rifle in position to steady its aim. However, many of these shooting rests have no ability to absorb recoil. As a result, when the rifle is fired, the recoil causes the rifle to bounce, which significantly affects the rifles aim and can potentially cause damage to the rifle.

Some shooting rests are built to absorb recoil. However, the recoil absorbing element of these shooting rests cannot be adjusted. Therefore, these rests prevent rifle bounce for some rifles, but not others. This is because the recoil absorbing means of these rests cannot absorb all of the recoil from rifles with heavy recoil, which causes these rifles to bounce when fired. However, if the recoil absorbing means is designed to absorb all of the recoil from a rifle with a heavy recoil, a rifle with a light recoil will not impact the recoil absorbing means enough to cause significant absorption, which in turn causes the rifle to bounce.

Additionally, these hunting rests must be secured to some stationary object to prevent the entire rest from bouncing when a rifle is fired. While many of these rests claim to be portable, they must be attached to a modified surface to prevent the rest from bouncing. This means that the rest cannot operate anywhere without a specially modified support surface being present.

Finally, many of these rests are not adjustable. This makes aiming the associated rifle difficult or impossible. Other rests claim to allow the user to aim the rifle in the rest, but aiming the rifle vertically in these rests places pressure on the rifle in a manner not intended by the rifle manufacturer. The butt stock of the rifle is designed to be placed against a persons shoulder. This puts the recoil absorbing means in contact with the entire butt stock of the rifle. The currently available shooting rests with adjustable aim place pressure on limited areas of the butt stock when the rifle is aimed at a vertical angle. This causes additional wear on the rifle's alignment and stock over time.

Therefore, what is needed is an adjustable recoil reducing shooting rest. The adjustable recoil reducing shooting rest should absorb recoil from a rifle, the recoil absorbing means should be adjustable, the rest should be securable to an unmodified support surface, and the user should be able to aim the rest and the associated rifle without placing uneven pressure on the rifle butt stock. Furthermore, other desirable features and characteristics of the present invention will become apparent when this background of the invention is read in conjunction with the subsequent detailed description of the invention, appended claims, and the accompanying drawings.

SUMMARY OF THE INVENTION

The present invention advantageously fills the aforementioned deficiencies by providing an adjustable recoil reducing shooting rest. The adjustable recoil reducing shooting rest absorbs recoil from a rifle, is adjustable, may secured to an unmodified support surface, and consistently supports the butt stock of the rifle regardless of the vertical angle of the rest.

The present invention now will be described more fully hereinafter with reference to the accompanying drawings, which are intended to be read in conjunction with both this summary, the detailed description, and any preferred and/or particular embodiments specifically discussed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

BRIEF DESCRIPTION OF THE DRAWINGS

The drawings contained herein exemplify one of the embodiments of the claimed invention. The invention is not limited to the embodiment shown. The embodiment shown is purely an example, and the invention is capable of many variations of said embodiment. In the drawings.

Figure 1:
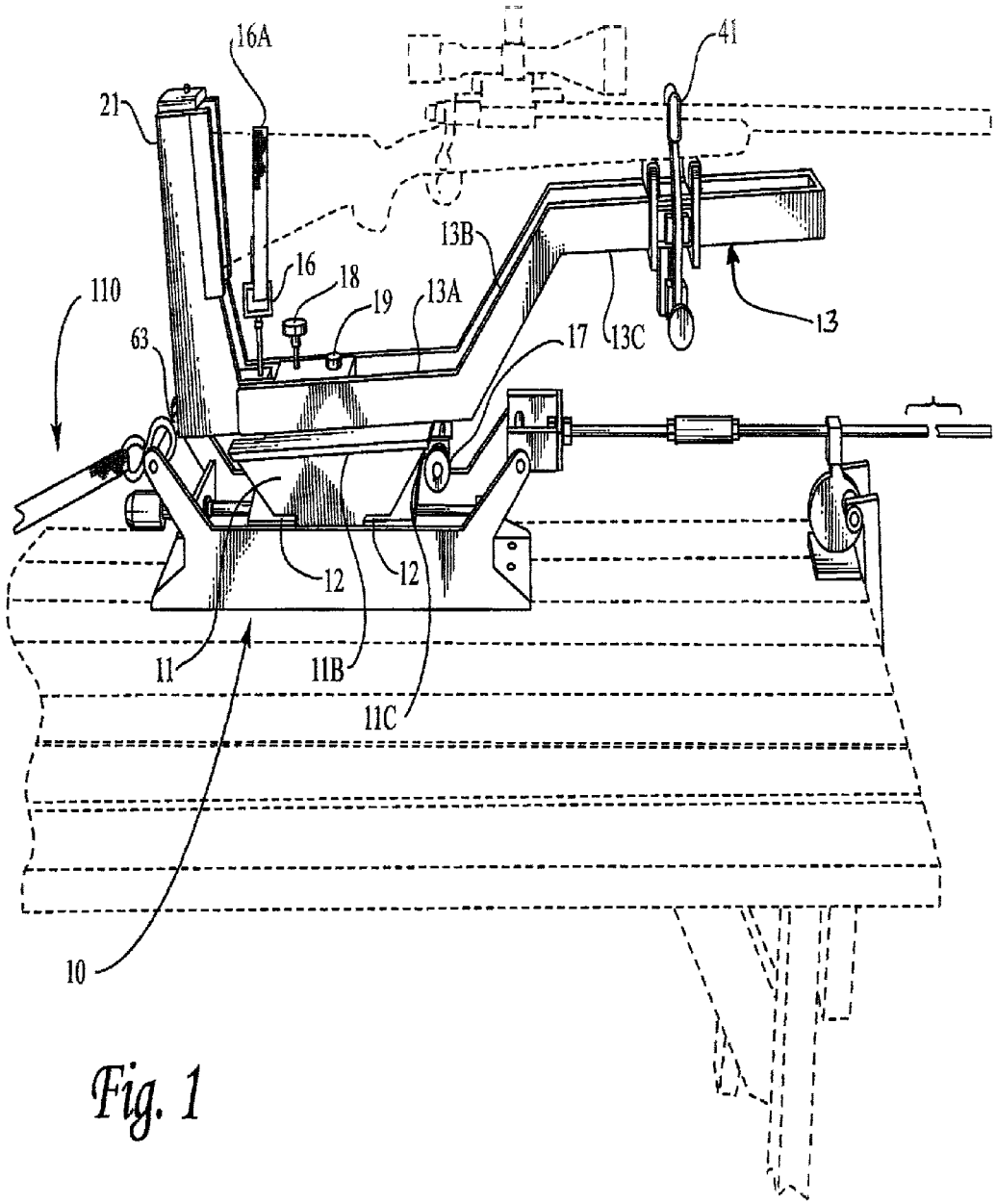
FIG. 1 illustrates a side perspective view of the present invention holding an example of a rifle.

The first digit of each reference numeral in the above figures indicates the figure in which an element or feature is most prominently shown. The second digit indicates related elements or features, and a final letter (when used) indicates a sub-portion of an element or feature.

DETAILED DESCRIPTION OF THE INVENTION

Figure 3:
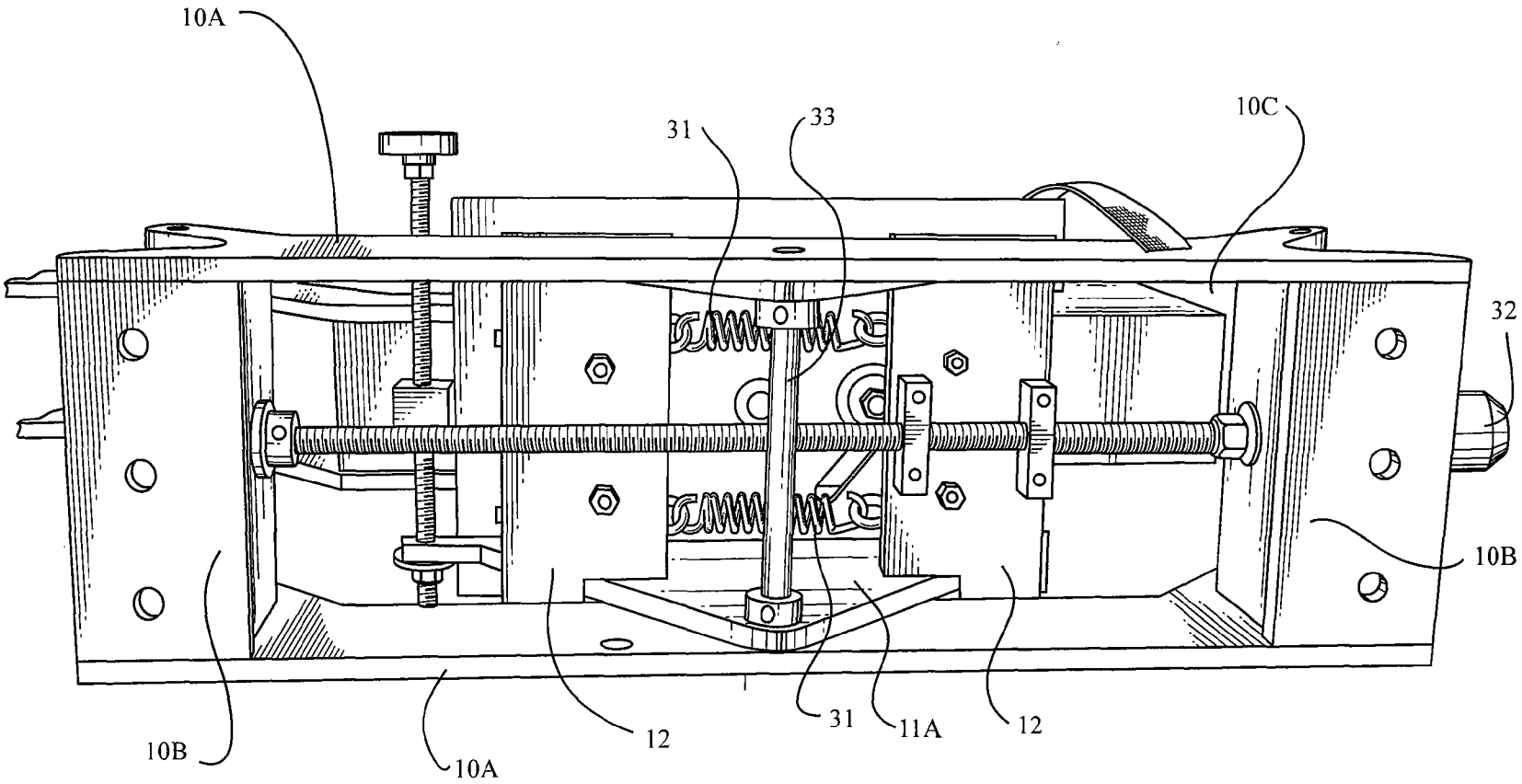
FIG. 3 illustrates a bottom plan view of the base of the present invention.

FIG. 1 illustrates a side perspective view of an adjustable recoil reducing shooting rest according to a preferred embodiment of the present invention. FIG. 1 discloses, among other components, a base member comprising a base 10. The base 10 serves as a support for the other components of the shooting rest. In the preferred embodiment, the base 10 comprises a three eighths inch aluminum flat bar. However, any durable material may be used. The forgoing notwithstanding, the base 10 should be light enough for a user to carry by hand, but heavy enough to support the other components and partially absorb the kinetic energy created when a rifle is fired while secured to the shooting rest. Referring briefly to FIG. 3, in the preferred embodiment, the base is a rectangular prism like shape comprising a central compartment 10C comprised of two sidewalls 10A and two end-walls 10B, with an open top and bottom. This central compartment 10C is accessible from either the top or the bottom of the base 10, for containing other components.

In the preferred embodiment, the base 10 further comprises a plurality of anchor crossbars 63. The base also comprises one or more attachment units which may be removably connected to the anchor crossbars 63 of the base 10. This allows the base member of the present invention to be securely attached to an unmodified support surface by means of an attachment unit or units. One example of an attachment unit is a primary attachment member 53 as discussed more fully below in reference to FIG. 5. The user may also employ one or more strap members 110 as attachment units to attach the base to the support surface. An attachment unit may also be any other similar device that can releasably attach the present invention to an unmodified support surface such as chains, cords, clamps, ropes, or the like.

FIG. 1 also discloses a primary adjustment member further comprising a vertical adjustment unit 11. In the preferred embodiment, the vertical adjustment unit 11 is further comprised of two triangular shaped sidewalls 11A and a rectangular shaped top-wall 11B attached to each sidewall 11A. Referring briefly to FIG. 3, the vertical adjustment unit 11 further comprises a crossbar 33 connecting each sidewall 11A. The vertical adjustment unit 11 is placed inside the central compartment 10C of the base 10 and the crossbar 33 is pivotally affixed to the sidewalls 10A of the base 10. Pivotally affixed means that one component is permanently attached to another component in such a manner that the first component can pivot relative to the second component. This configuration allows the vertical adjustment unit 11 to pivot when the base 10 is stationary. When a rifle is placed in the present invention, the pivoting action of the vertical adjustment unit 11 allows the user to adjust the vertical position of the barrel and thereby adjust the weapons aim in the vertical plane.

The primary adjustment member further comprises one or more primary retaining units 12. In the preferred embodiment, the primary adjustment member comprises two primary retaining units 12. These primary retaining units 12 are placed in contact with the vertical adjustment unit 11. The primary retaining units 12 prevent the vertical adjustment unit 11 from pivoting without some form of user adjustment, and thereby perform the function of adjustably retaining the primary adjustment member 11 in position relative to the base member. In the preferred embodiment, each primary retaining unit 12 further comprises two slots. The primary retaining unit 12 is then placed so that each slot encloses a portion of each vertical adjustment unit sidewall 11A. Referring briefly to FIG. 3, in the preferred embodiment, the primary adjustment unit further comprises one or more support units 31. The two primary retaining units 12 are connected by the support units 31. In the preferred embodiment, the support units 31 comprise two springs. In this configuration, the slot contact between the primary retaining units 12 and vertical adjustment unit sidewalls 11A coupled with the pressure from the support units 31 prevent the retaining units 12 and the vertical adjustment unit 11 from moving without user adjustment as discussed herein below in reference to FIG. 3.

FIG. 1 also discloses a cradle member further comprising a horizontal adjustment unit 13. The horizontal adjustment unit 13 is pivotally affixed to the top-wall 11B of the vertical adjustment unit 11 by a vertical crossbar 19. This allows the cradle member to pivot freely in the horizontal plane and thereby allows the user to change the horizontal aim of a rifle, when said rifle is present. In the preferred embodiment, the horizontal adjustment unit 13 comprises a rear section 13A, a raised section 13B, and a rail section 13C.

Figure 6:
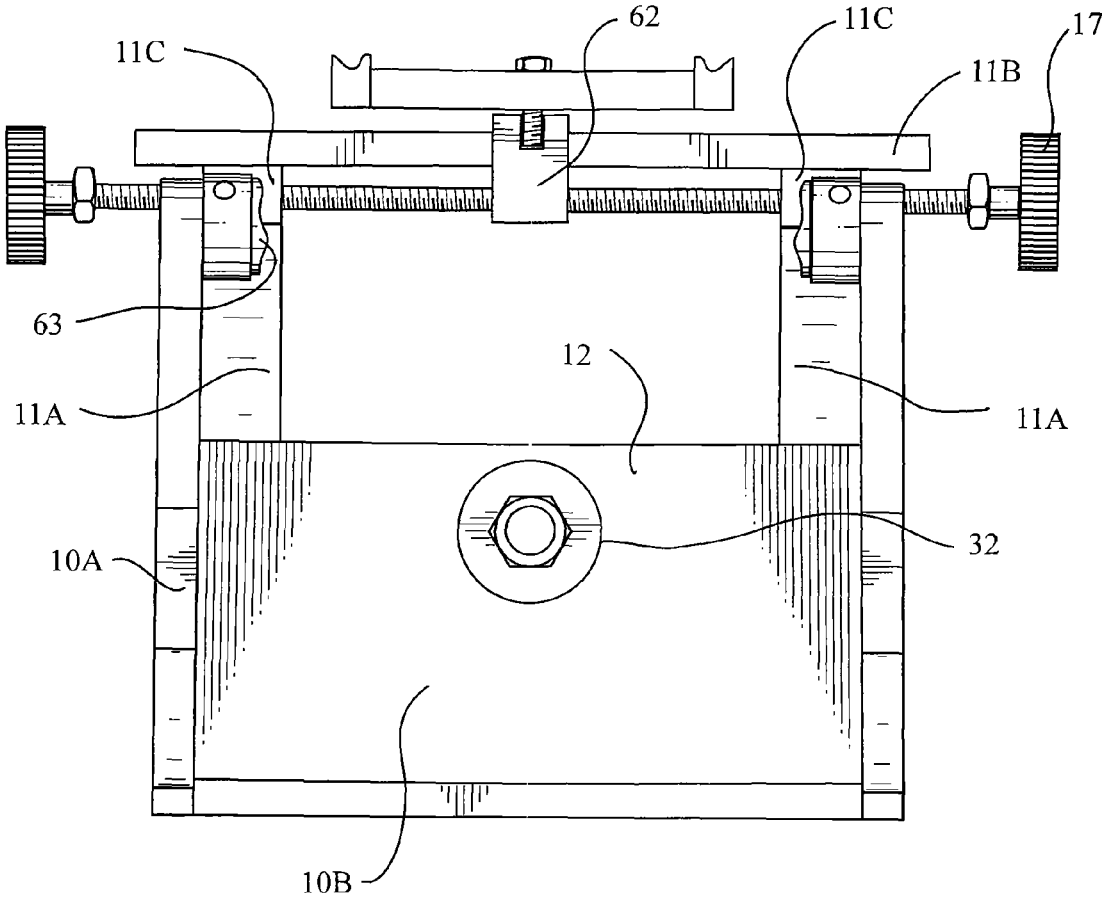
FIG. 6 illustrates a front plan view of the base showing the horizontal control unit and related components.

The primary adjustment member further comprises a horizontal control unit 17. Referring briefly to FIG. 6, the vertical adjustment unit 11 further comprises two attachment points 11C, attached to the vertical adjustment unit side-walls 11A. The horizontal control unit 17 is rotationally connected to each of the attachment points 11C of the vertical adjustment unit 11. Rotationally connected means that the components are connected in such a way that at least one of the components can rotate while remaining connected to the other component or components. The primary adjustment member further comprises a horizontal connection unit 62 attached to the horizontal adjustment unit 13 of the cradle member. The horizontal connection unit 62 is rotationally connected to the horizontal control unit 17. This causes the horizontal control unit 17 to be rotationally connected to the horizontal adjustment unit 13. In the preferred embodiment, the horizontal control unit 17 further comprises adjustment handles. In this configuration, the orientation of the horizontal adjustment unit 13 is controlled by turning the adjustment handles of the horizontal control unit 17, which causes the horizontal control unit 17 to rotate. The rotation of the horizontal control unit 17 causes the horizontal connection unit 62 to move along the horizontal control unit 17, which moves the attached horizontal adjustment unit 13 in the horizontal plane.

The cradle member further comprises a receiving unit 41 connected to the horizontal adjustment unit 13. In the preferred embodiment, the receiving unit 41 should be slidably connected to the rail section 13C of the horizontal adjustment unit 13, allowing the receiving unit 41 to slide to any position on the rail section 13C to accept rifles of different lengths. However, the receiving unit 41 should be prevented from sliding onto the raised section 13B or sliding free of the rail section 13C. The purpose of the receiving unit 41 is to be capable of securely receiving the forward portion of a rifle. The forward portion of a rifle may be the rifle barrel or the forestock. The operation of the receiving unit 41 is discussed in greater detail below in reference to FIG. 4.

The cradle member further comprises a primary stock support unit 21, affixed to the rear section of the horizontal adjustment unit 13A. When in use, the butt stock of a rifle may be placed against the primary stock support unit 21 and the barrel placed in the receiving unit 41. Because the entire cradle moves when the rifle is aimed, using the horizontal adjustment unit 13 and vertical adjustment unit 11, the primary stock support unit 21 consistently supports the butt stock of the rifle regardless of the position of either the horizontal adjustment unit 13 or the vertical adjustment unit 11. This ensures that stress is distributed evenly on the rifles butt stock when the rifle is fired. The primary stock support unit is discussed in greater detail in relation to FIG. 2 herein below.

Figure 2:
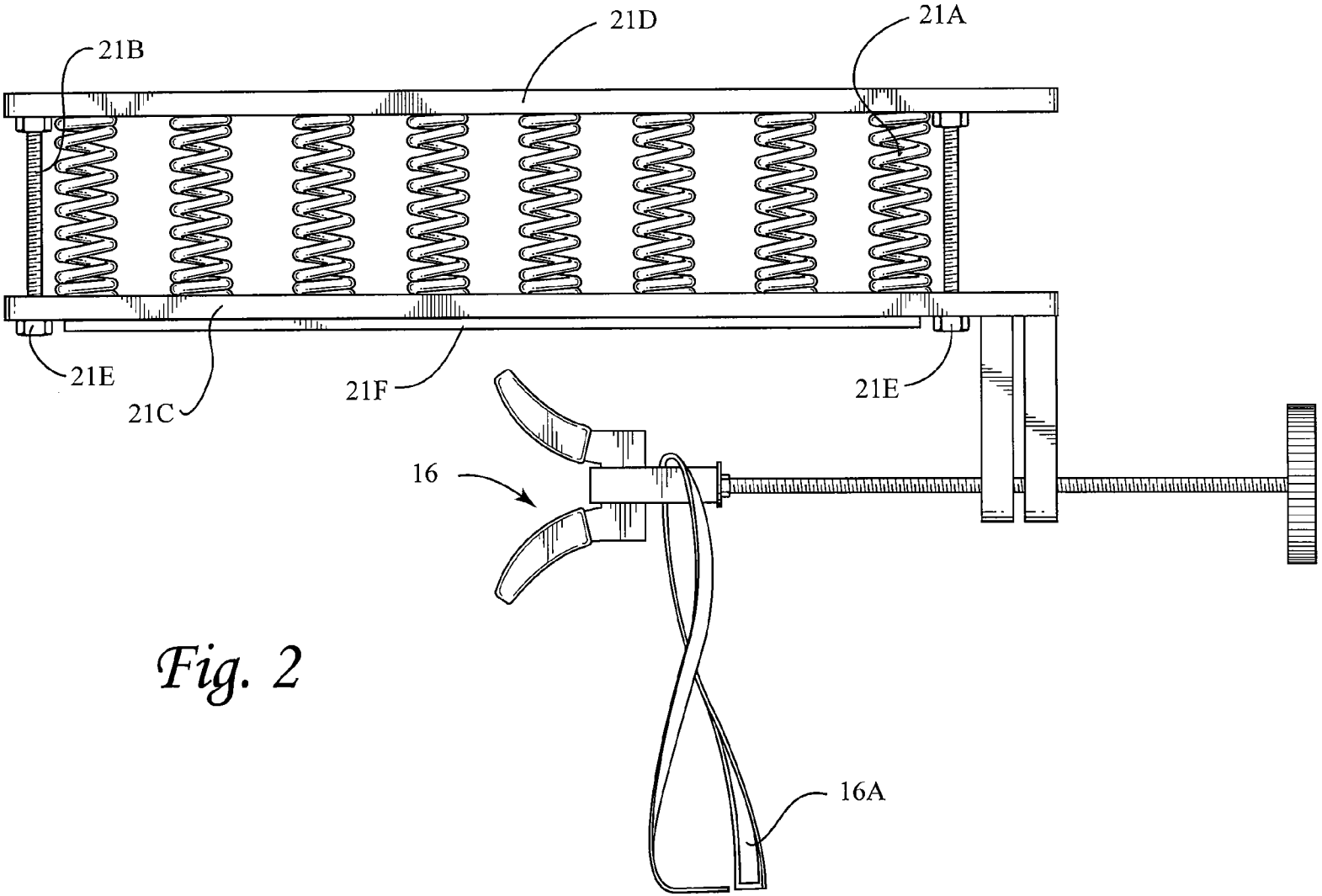
FIG. 2 illustrates a side sectional view of the stock support unit of the present invention.

In the preferred embodiment, the cradle member also comprises a secondary stock support unit 16 connected to the primary stock support unit 21. The secondary stock support unit 16 supports the stock of any rifle placed in the cradle and prevents the rifle from sliding down the primary stock support unit 21. As can be seen in FIG. 2, the secondary stock support unit 16 connects to the primary stock support unit 21 by a threaded bolt and can be adjusted vertically to accommodate different rifles. The secondary stock support unit 16 may also comprise a retaining strap 16A which may be placed around a rifle stock and attached via Velcro, snaps, or similar means to further restrict the rifles movement. It should be noted that while the secondary stock support unit 16 is useful to restrict unwanted rifle movement, its presence is not required for the normal operation of the present invention. The receiving unit 41 and the primary stock support unit 21 are capable of retaining the rifle without the need of the secondary stock support unit 16. The secondary stock support unit 16 also assists the user by holding the rifle as the barrel or forestock of the rifle is being secured in the receiving unit 41.

In the preferred embodiment, the cradle member may also comprise one or more secondary retaining units 18. In the preferred embodiment, the secondary retaining unit 18 is a bolt, or similar structure, that can be rotationally connected to the horizontal adjustment unit 13A and to the vertical adjustment unit 11 in such a way that engaging the secondary retaining unit 18 prevents the horizontal adjustment unit 13A from moving. This performs the function of granting additional support to the horizontal control unit 17, and helps prevent the cradle from making unwanted horizontal movements. It should be noted that while the horizontal lock is useful, it is not required for the proper function of the present invention.

FIG. 2 illustrates a sectional view of the primary stock support unit 21 of the present invention. The primary stock support unit 21 further comprises one or more recoil dampening devices 21A for adjustably dampening the recoil of any rifle that is fired while secured in the present invention. The preferred embodiment of the present invention comprises eight recoil dampening devices 21A that can be removed or replaced by the user to increase or decrease the resistance of the dampening action. It should be noted that optimal operation of the present invention is achieved when the recoil dampening devices 21A create enough resistance to partially compress when a rifle is fired. If the recoil dampening devices 21A completely compress due to low resistance or do not compress at all due to high resistance, the rifle is more likely to bounce, decreasing the accuracy and reliability of the rifle's aim while secured in the present invention and subjecting the rifle to potential damage. Since each rifle exerts a different amount of recoil pressure when fired, the user may remove or replace the recoil dampening devices 21A until the optimal resistance is achieved.

In the preferred embodiment, the primary stock support unit 21 further comprises a front plate 21C, a rear plate 21D, and four tension supports 21B. The tension supports 21B are affixed to the rear plate 21D and slidably connected to the front plate 21C by the tension support heads 21E. In this configuration, under most conditions, the pressure exerted by the recoil dampening devices 21 on the front plate 21C forces the front plate 21C to slide down the tension supports 21B to the tension support heads 21E and remain at a maximum distance from the rear plate 21D. When a weapon is fired in the present invention, the front plate 21C transfers the recoil pressure to the recoil dampening devices 21A and slides along the tension supports 21B toward the rear plate 21D. Once the recoil pressure has been absorbed and distributed throughout the shooting rest, the front plate 21C returns to its standard position as noted above. It should be noted that, in an alternate embodiment, the tension supports 21B could be affixed to the front plate 21C and slideably connected to the rear plate 21D without significantly effecting the overall function of the present invention.

In the preferred embodiment, the primary stock support unit 21 further comprises a stock support pad 21F. The purpose of the stock support pad 21F is to further dampen the recoil of any rifle fired while secured to the present invention. The stock support pad 21F also reduces possibility that the rifle will receive a scratch or gouge from impact with the primary stock support unit 21. However, it should be noted that the stock support pad 21F may be omitted without significantly affecting the overall function of the present invention.

FIG. 3 illustrates a bottom perspective view of the base of the present invention. As mentioned above, the central compartment 10C contains several of the present inventions components. As mentioned above, the sidewalls of the vertical adjustment unit 11A are placed inside the central compartment 10C and the crossbar 33 connects to each sidewall 11A and is pivotally connected to the sidewalls of the base 10A. The retaining units 12 retain the vertical adjustment unit 11 in position and are connected by one or more support units 31.

The vertical adjustment unit 11 further comprises a vertical control unit 32. The vertical control unit 32 is affixed to both end-walls 10B of the base 10 and is rotationally connected to one or both of the primary retaining units 12. The vertical control unit 32 is preferably a threaded rod, bolt, or a like device. The vertical control unit 32 is also preferably attached to an adjustment handle. The vertical control unit 32 turns when the handle is turned. The rotational connection between the primary retaining units 12 and the vertical control unit 32 causes the primary retaining units 12 to move along the vertical control unit 32. The movement of the primary retaining units 12 along the vertical control unit 32 forces movement in the vertical adjustment unit 11 which in turn changes the vertical aim of the cradle member. In this configuration, movement of the handle of the vertical control unit 32 changes the vertical aim of any rifle in the shooting rest.

Figure 4:
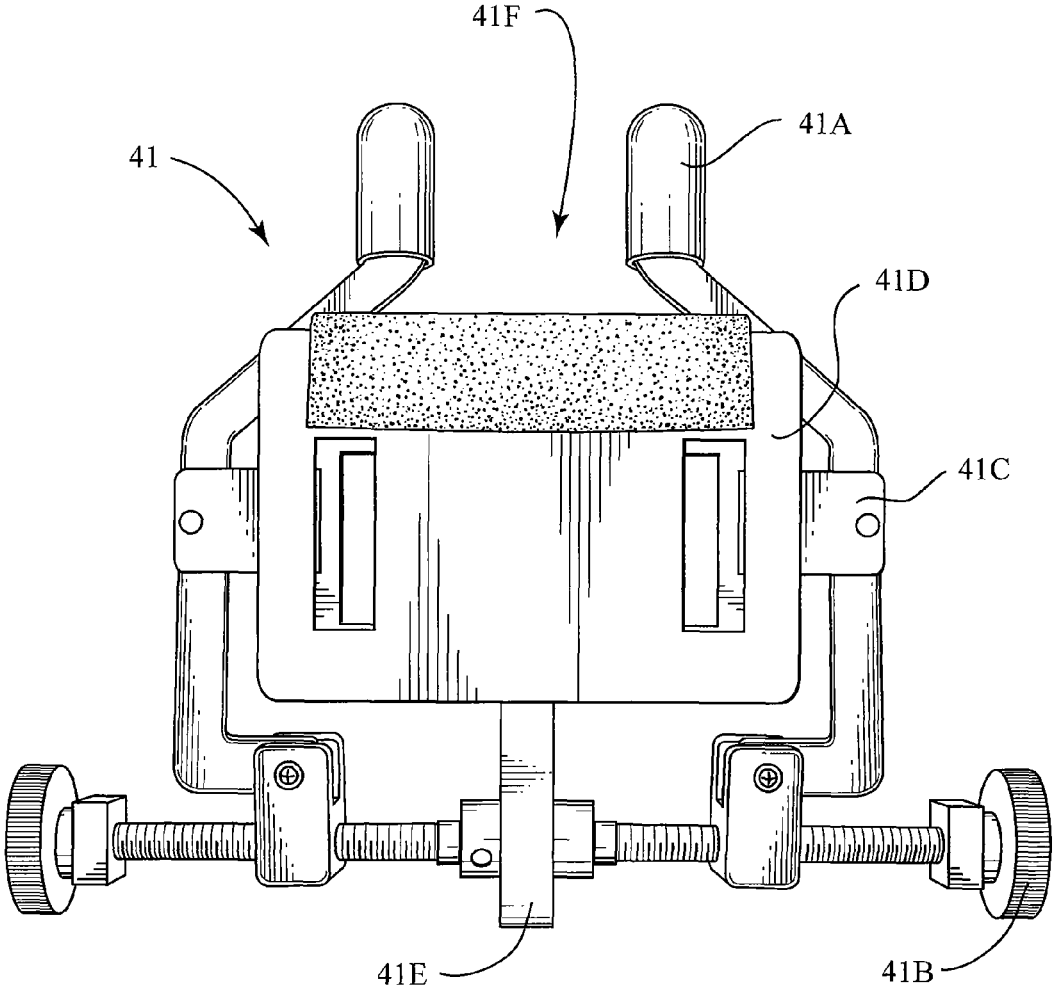
FIG. 4 illustrates a front sectional view of the receiving unit of the present invention.

FIG. 4 illustrates a sectional view of the receiving unit 41 of the present invention. The receiving unit 41 comprises a slide member 41D which is slidably connected to the rail section of the horizontal adjustment device 13C. In the preferred embodiment, the slide member 41D comprises two openings which enclose each rail of the rail section 13C.

The receiving unit 41 also comprises two fulcrum units 41C affixed to the slide member 41D. The receiving unit 41 also comprises two gripping units 41A. Each gripping unit 41A is attached to a fulcrum unit 41C. The receiving unit 41 further comprises a central post 41E affixed to the slide member 41D. The receiving unit 41 also comprises a receiving control unit 41B. The receiving control unit 41B is preferably a threaded rod, bolt, or like device. The receiving control unit 41B should have one or more handles and should be rotationally connected to each gripping unit 41A and the central post 41E. The threads on the receiving control unit 41B should run counter clockwise on one side of the central post 41E and clockwise on the other side of the central post 41E. In this configuration, the center of the receiving control unit 41B will remain inside the center post 41E when the receiving control unit 41B is manipulated by the user. Because the threads on each end of the receiving control unit 41B are oriented in opposite directions, as mentioned above, the gripping units 41A each move in opposite directions when the receiving control unit 41B is manipulated by the user. The gripping unit 41A attachment to the fulcrum unit 41C, in combination with the aforementioned directional motion by each gripping unit 41A in response to the receiving control unit 41B, causes the gripping units 41A to grip or release above the slide member 41D when the receiving control unit 41B is manipulated by a user. This gripping action allows the receiving unit to securely receive the barrel of a rifle and release the rifle when the user desires. Also, the receiving unit 41 may comprise a barrel foam support 41F to prevent a rifle that has been securely received by the receiving unit 41 from scratching against the slide member 41D and possibly scarring the rifle.

Figure 5:
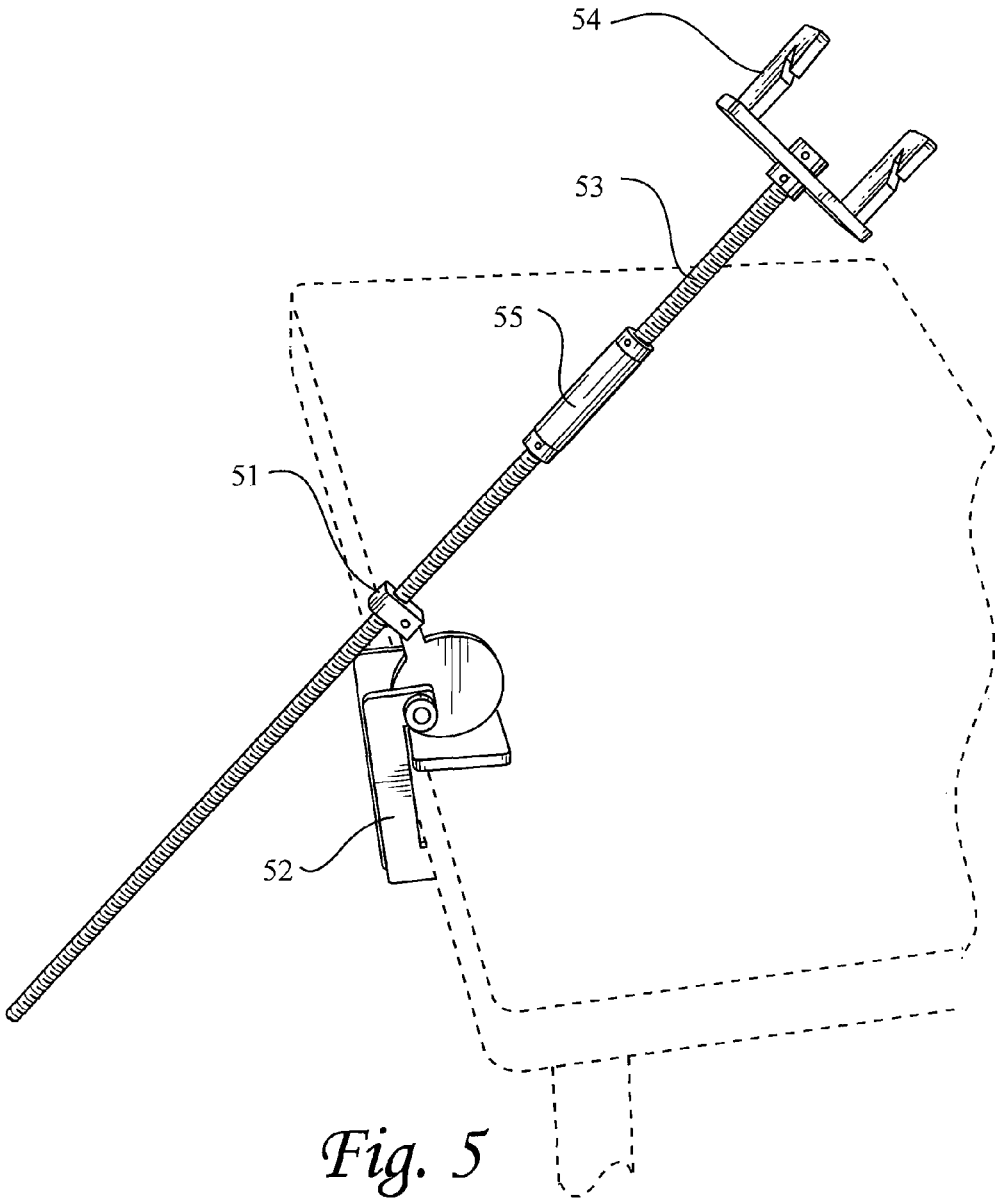
FIG. 5 illustrates a side perspective view of a primary attachment member attached to a support surface.

FIG. 5 a side perspective view of a primary attachment member 53 attached to a support surface. In the preferred embodiment, the primary attachment member 53 comprises a threaded rod, or similar device, a clamp unit 52, and a link unit 51. The threaded rod is rotationally connected to a clamp unit 52 via the link unit 51. The clamp unit 52 may be any device that is capable of securely attaching to a support surface.

The primary attachment member 53 further comprises a base connection unit 54 connected to the threaded rod. The base connection unit 54 is capable of releasably attaching to anchor crossbar 63 the base 10. This configuration has the effect of securely attaching the base 10 to a support surface and preventing the present invention from bouncing when a rifle is fired. In the preferred embodiment, the primary attachment member 53 further comprises a handle 55 which is affixed to the threaded rod. The handle 55 is present to allow the user to twist the threaded rod through the link unit 51 and thereby adjust the length of the primary attachment member 53 as needed to properly attach to the base 10 as it sits on a given support surface.

FIG. 6 illustrates a front plan view of the base 10. As indicated above, the base 10 comprises an anchor crossbar 63. The present view cuts away a section of the anchor crossbar 63 to show the connections between the horizontal control unit 17 and the horizontal connection unit 62 and attachment points 11C, as discussed above. It should be noted that the anchor crossbar 63 is not altered by its depiction in this Figure. It should also be noted that this figures depiction of the width of the sidewalls 11A of the vertical adjustment unit 11 has been exaggerated from the preferred embodiment to show the sidewalls 11A, the attachment points 11C, and a portion of the anchor crossbar 63.

The method of use of the present invention is now discussed hereinbelow. The user should place the adjustable recoil reducing shooting rest on a support surface. The support surface should be strong enough and stable enough to hold the present invention and a rifle, however, the support surface does not need any particular modifications. The base 10 of the present invention should then be securely attached to the support surface by means of any combination of attachment units as discussed hereinabove. The user may then place the rifle in the cradle of the shooting rest. The rifle should be secured in the cradle member by placing the buttstock of the rifle against the primary stock support 21 and the barrel should be securely received by the receiving unit 41. The resistance of the primary stock support 21 should be adjusted by replacing or removing recoil dampening devices 21A from the primary stock support 21 until the desired resistance is achieved. The user may then adjust the vertical aim of the rifle by manipulating the vertical control unit 32 of the vertical adjustment unit 11. The user may also adjust the horizontal aim of the rifle by manipulating the horizontal control unit 17 of the horizontal adjustment unit 13. Once the rifle has been aimed to the user's satisfaction, the rifle may be fired repeatedly at the same target or location.

It should be noted that the foregoing disclosure sometimes labels components with terms like front, rear, bottom, top, primary, secondary, side, horizontal, vertical, and the like. These terms are used for ease of identification purposes only and are not intended as limiting language. A person of ordinary skill in the art will understand that the orientation of many of the components contained herein can be changed to an equivalent structure without significantly affecting the overall function of the present invention. This disclosure is intended to cover and does cover all such equivalent embodiments.

While the present invention has been described above in terms of specific embodiments, it is to be understood that the invention is not limited to these disclosed embodiments. Many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

I claim:

1. An adjustable recoil reducing shooting rest, comprising:

a base member comprising first and second spaced apart sidewalls;

a primary adjustment member comprising a vertical adjustment unit comprising a top wall attached to first and second spaced apart sidewalls positioned intermediate the first and second sidewalls of the base member, wherein the vertical adjustment unit is pivotally affixed to the base member, and one or more primary retaining units, in contact with the vertical adjustment unit, for adjustably retaining the primary adjustment member in position relative to the base member; and a cradle member supported by the top wall of the vertical adjustment unit, and comprising a horizontal adjustment unit pivotally affixed to the vertical adjustment unit, a receiving unit, connected to the horizontal adjustment unit, capable of securely receiving a forward portion of a rifle, and a primary stock support unit, affixed to the horizontal adjustment unit, for supporting the butt stock of a rifle, and wherein the vertical adjustment unit can move the cradle member in a range of vertical motion.

2. The adjustable recoil reducing shooting rest of claim 1, wherein the base member further comprises one or more attachment units which are removably connected to the base for securely attaching the base member to an unmodified support surface.

3. The adjustable recoil reducing shooting rest of claim 2, wherein the attachment units comprise at least one strap member, and further comprise a primary attachment member comprising a threaded rod, clamp unit, link unit, handle, and a base connection unit.

4. The adjustable recoil reducing shooting rest of claim 1, wherein the primary adjustment member comprises two primary retaining units, and one or more support units connected to both primary retaining units.

5. The adjustable recoil reducing shooting rest of claim 4, wherein the primary adjustment member further comprises a vertical control unit affixed to the base and rotationally connected to at least one of the primary retaining units.

6. The adjustable recoil reducing shooting rest of claim 1, wherein the receiving unit is slidably connected to the horizontal adjustment unit.

7. The adjustable recoil reducing shooting rest of claim 1, wherein the receiving unit further comprises two gripping units, and a receiving control unit rotationally connected to the gripping units.

8. The adjustable recoil reducing shooting rest of claim 1, wherein the primary adjustment member further comprises a horizontal control unit rotationally connected to the vertical adjustment unit and to the horizontal adjustment unit.

9. The adjustable recoil reducing shooting rest of claim 1, wherein the base member further comprises first and second end walls, the first and second end walls and the first and second sidewalls of the base member defining a central compartment.

10. The adjustable recoil reducing shooting rest of claim 1, wherein the primary stock support unit further comprises one or more recoil dampening devices.

11. The adjustable recoil reducing shooting rest of claim 1, wherein the base member further comprises first and second end walls.

12. The adjustable recoil reducing shooting rest of claim 1, wherein the vertical adjustment unit further comprises a cross bar connected to each of the first and second sidewalls of the vertical adjustment unit and pivotally affixed to the first and second sidewalls of the base member.

13. The adjustable recoil reducing shooting rest of claim 12, wherein the first and second sidewalls of the vertical adjustment unit are substantially triangular, and the top wall is substantially rectangular.

14. An adjustable recoil reducing shooting rest comprising:

(a) a base member for positioning on a surface;

(b) a cradle member comprising a rail section having first and second sidewalls, a receiving unit adapted for receiving and supporting a forward portion of a rifle, and a primary stock support unit for receiving and supporting the butt stock of a rifle, the receiving unit slidably connected to the rail section whereby the receiving unit is moveable to varying positions on the rail section to accommodate rifles of varying length;

(c) a vertical adjustment unit functionally connected to the cradle for moving the cradle in a range of vertical motion; and (d) a horizontal adjustment unit functionally connected to the cradle for moving the cradle in a range of horizontal motion.

15. An adjustable recoil reducing shooting rest according to claim 14, wherein the receiving unit comprises:

(a) a slide member slidably connected to the rail section of the cradle;

(b) first and second fulcrum units connected to the slide member; and (c) a first gripping unit attached to the first fulcrum unit, and a second gripping unit attached to the second fulcrum unit.

16. An adjustable recoil reducing shooting rest comprising:

(a) base member comprising first and second spaced apart sidewalls;

(b) a primary adjustment member comprising a vertical adjustment unit comprising a top wall attached to first and second spaced apart sidewalls positioned intermediate the first and second sidewalls of the base member, wherein the vertical adjustment unit is pivotally affixed to the base member; and (c) a cradle member supported by the top wall of the vertical adjustment unit, and comprising a horizontal adjustment unit pivotally affixed to the vertical adjustment unit, a receiving unit for receiving a forward portion of a rifle, and a primary stock support unit for receiving and supporting the butt stock of a rifle comprising at least one recoil dampening device for adjustably dampening the recoil of a rifle.

17. An adjustable recoil reducing shooting rest according to claim 16, wherein the cradle member comprises a rail section having first and second sidewalls, and the receiving unit is slidably connected to the rail section whereby the receiving unit is moveable to varying positions on the rail section to accommodate rifles of varying length.

18. An adjustable recoil reducing shooting rest according to claim 17, wherein the at least one recoil dampening device comprises four tension supports.

19. An adjustable recoil reducing shooting rest according to claim 16, wherein the vertical adjustment unit further comprises a cross bar connected to each of the first and second sidewalls of the vertical adjustment unit and pivotally affixed to the first and second sidewalls of the base member.

20. An adjustable recoil reducing shooting rest according to claim 19, wherein the first and second sidewalls of the vertical adjustment unit are substantially triangular, and the top wall is substantially rectangular.

* * * * *